US008087659B2

(12) United States Patent
Kakishima et al.

(10) Patent No.: US 8,087,659 B2
(45) Date of Patent: Jan. 3, 2012

(54) CONVEYING DEVICE, METHOD OF CONTROLLING THE CONVEYING DEVICE, AND RECORDING DEVICE USING THE CONVEYING DEVICE

(75) Inventors: Hiroyuki Kakishima, Kawasaki (JP); Shinya Sonoda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 1028 days.

(21) Appl. No.: 11/770,465

(22) Filed: Jun. 28, 2007

(65) Prior Publication Data

US 2008/0006982 A1 Jan. 10, 2008

(30) Foreign Application Priority Data

Jul. 7, 2006 (JP) ..... 2006-188045

(51) Int. Cl.
*B65H 5/00* (2006.01)

(52) U.S. Cl. ..... 271/10.01; 271/10.03

(58) Field of Classification Search ..... 271/10.01, 271/10.03, 10.04, 10.09, 10.11, 10.12
See application file for complete search history.

(56) References Cited

U.S. PATENT DOCUMENTS

| | | | | |
|---|---|---|---|---|
| 5,194,970 | A * | 3/1993 | Iwanade | 358/498 |
| 6,135,439 | A * | 10/2000 | Ikeda | 271/10.03 |
| 6,729,613 | B2 * | 5/2004 | Marra, III et al. | 271/10.02 |
| 7,334,787 | B2 * | 2/2008 | Akiyama et al. | 271/10.02 |
| 7,357,387 | B2 * | 4/2008 | Asada | 271/110 |
| 7,584,951 | B2 * | 9/2009 | Otani et al. | 271/10.01 |

FOREIGN PATENT DOCUMENTS

| | | | |
|---|---|---|---|
| JP | 2002-332135 | A | 11/2002 |
| JP | 2002-361958 | A | 12/2002 |
| JP | 2003-291433 | A | 10/2003 |
| JP | 2005-247459 | A | 9/2005 |
| JP | 2006-130789 | A | 5/2006 |

* cited by examiner

*Primary Examiner* — Kaitlin Joerger
(74) *Attorney, Agent, or Firm* — Canon USA, Inc., I.P. Division

(57) ABSTRACT

A conveying device in which positional displacement of a sheet may occur due to, for example, backlash of a mechanical system is provided. In the conveying device, when the speed of an encoder is decelerated to a predetermined speed after an edge of a sheet abuts against a roller during conveyance of the sheet, an encoder position is obtained. After the roller stops due to the backlash, an encoder position is obtained again. An amount of conveyance of the sheet to a print start position is corrected on the basis of the two encoder positions that have been obtained.

8 Claims, 8 Drawing Sheets

CONVEYING DEVICE, METHOD OF CONTROLLING THE CONVEYING DEVICE, AND RECORDING DEVICE USING THE CONVEYING DEVICE

BACKGROUND OF THE INVENTION

1. Field of the Invention

The present invention relates to a conveying device, a method of controlling the conveying device, and a recording device.

2. Description of the Related Art

To prevent oblique movement of a sheet in a recording device (e.g., printer), a sheet transport device transports the sheet by abutting an edge of the sheet against a stationary roller and, then, by rotating the roller.

A recording device has a structure in which two rollers for transporting a sheet are driven by one motor (refer to Japanese Patent Laid-Open No. 2002-332135). In this structure, a plurality of transmitting units for transmitting driving force of the motor to the rollers are provided.

However, such transmitting units generate undesired torque, such as backlash. For example, torque is generated due to backlash between the rollers connected to each other by gear trains, springiness of a timing belt, or a flexing force in a sheet that is transported.

Undesired torque that is generated in such a transport system may cause unintended rotation of the rollers. Therefore, even if a sheet is transported by a predetermined transportation amount, the position of the sheet may become shifted due to the undesired torque.

SUMMARY OF THE INVENTION

Accordingly, an embodiment of the present invention provides a device for conveying a sheet to a proper position without being influenced by undesired torque that is generated at a conveying system.

According to one aspect of the present invention, there is provided a conveying device comprising a sheet-feed roller, a conveying roller, a DC motor, a motor control unit, a driving unit, a determining unit, and a control unit. The sheet-feed roller picks up a sheet stacked at a sheet-stacking portion. The conveying roller conveys the sheet conveyed by the sheet-feed roller. The DC motor serves as a driving source of the sheet-feed roller and the conveying roller. The motor control unit is configured to control driving of the DC motor using information obtained from an encoder. The driving unit is configured to drive the DC motor as a result of inputting a control signal of a PWM waveform generated by the motor control unit. The determining unit is configured to determine a timing in which the sheet conveyed by the sheet-feed roller reaches the conveying roller, on the basis of a threshold value and the control signal. The control unit is configured to, after rotation of the sheet-feed roller is started, stop the rotation of the sheet-feed roller on the basis of the timing determined by the determining unit, and to start rotation of the conveying roller after waiting for a predetermined time after the rotation of the sheet-feed roller is stopped. The control unit controls an amount of conveyance of the conveying roller on the basis of an amount of change in position information obtained from the encoder while waiting.

According to another aspect of the present invention, there is provided a recording device that performs recording on a recording position using a recording head, and that comprises a sheet-feed roller, a conveying roller, a DC motor, a motor control unit, a driving unit, a determining unit, and a control unit. The sheet-feed roller picks up a sheet stacked at a sheet-stacking portion. The conveying roller conveys the sheet conveyed by the sheet-feed roller to the recording position. The DC motor serves as a driving source of the sheet-feed roller and the conveying roller. The motor control unit is configured to control driving of the DC motor using information obtained from an encoder. The driving unit is configured to drive the DC motor as a result of inputting a control signal of a PWM waveform generated by the motor control unit. The determining unit is configured to determine a first timing and a second timing. The first timing is determined on the basis of a threshold value and the control signal and is a timing in which the sheet conveyed by the sheet-feed roller reaches the conveying roller. The second timing is a timing in which the conveying roller is stopped after the first timing. The control unit is configured to stop rotation of the sheet-feed roller on the basis of the first timing after the rotation of the sheet-feed roller is started, and to start rotation of the conveying roller after waiting for a predetermined time after the rotation of the sheet-feed roller is stopped. The control unit controls an amount of conveyance of the conveying roller on the basis of position information provided after waiting and position information based on the second timing. The items of position information are obtained from the encoder.

Further features of the present invention will become apparent from the following description of exemplary embodiments with reference to the attached drawings.

DESCRIPTION OF THE EMBODIMENTS

Embodiments of the present invention will hereunder be described in detail with reference to the attached drawings.

The embodiments which are described in detail below with reference to the attached drawings are preferred embodiments of the present invention.

Figure 1:
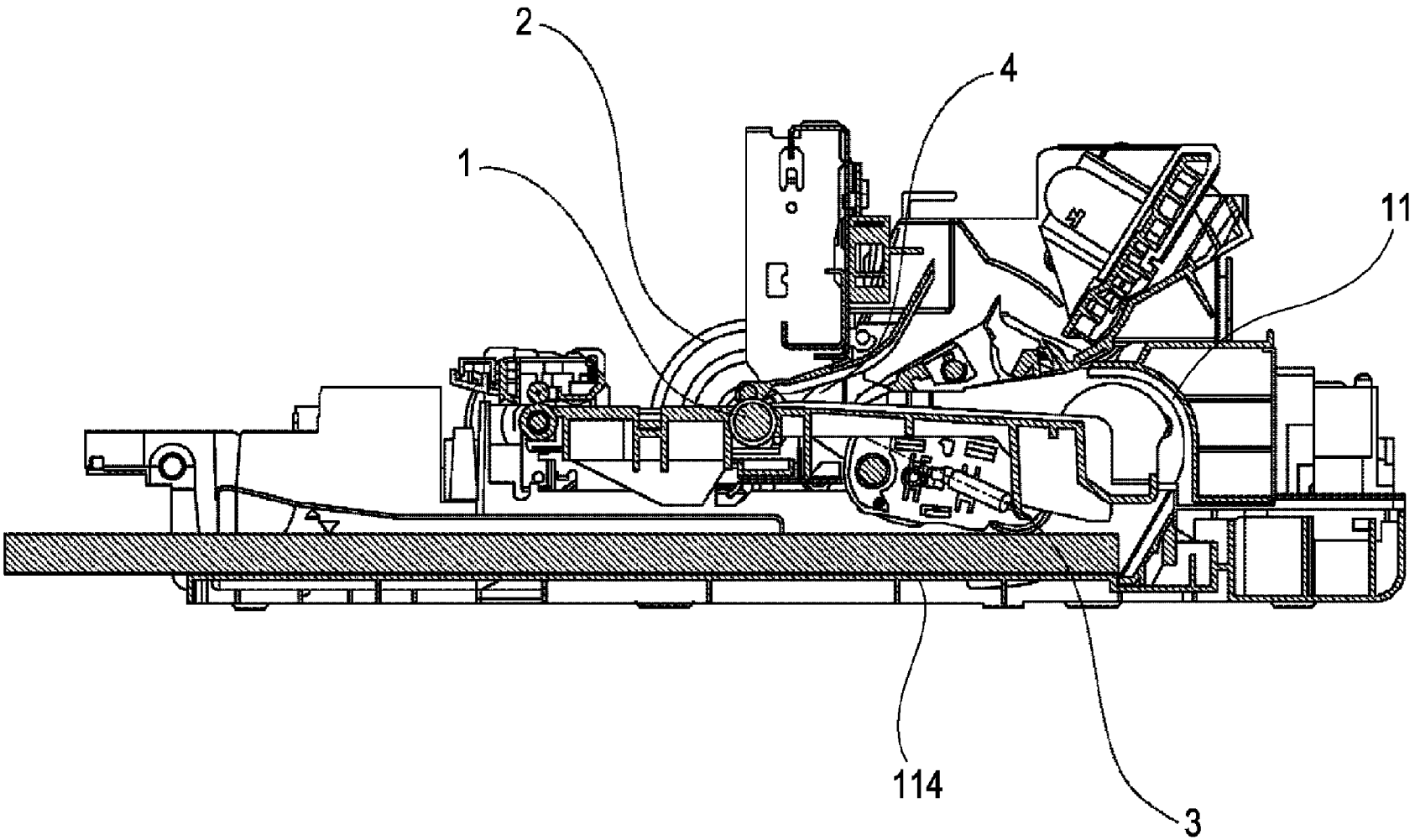
FIG. 1 is a side view of a mechanical portion of a recording device according to an embodiment of the present invention.

FIG. 1 is a side view of a mechanical portion of a conveying device (recording device) according to an embodiment of the present invention. Reference numeral 1 denotes an LF roller, and reference numeral 2 denotes an encoder. The LF roller 1 conveys a sheet. The encoder 2 outputs a signal in accordance with the rotation of the LF roller, and is mounted coaxially with the LF roller 1. The signal from the encoder 2 allows information regarding rotation amount and rotational speed of the LF roller 1 to be obtained. Reference numeral 3 denotes a sheet-feed roller for feeding sheets to a tray (stacking portion). Reference numeral 4 denotes a PE sensor for detecting an edge of a sheet.

As shown in FIG. 1, the sheet-feed roller 3 picks up a sheet from a tray 114. Then, the sheet is conveyed to a U-shaped guide 11, the PE sensor 4, and the LF roller 1.

Figure 2:
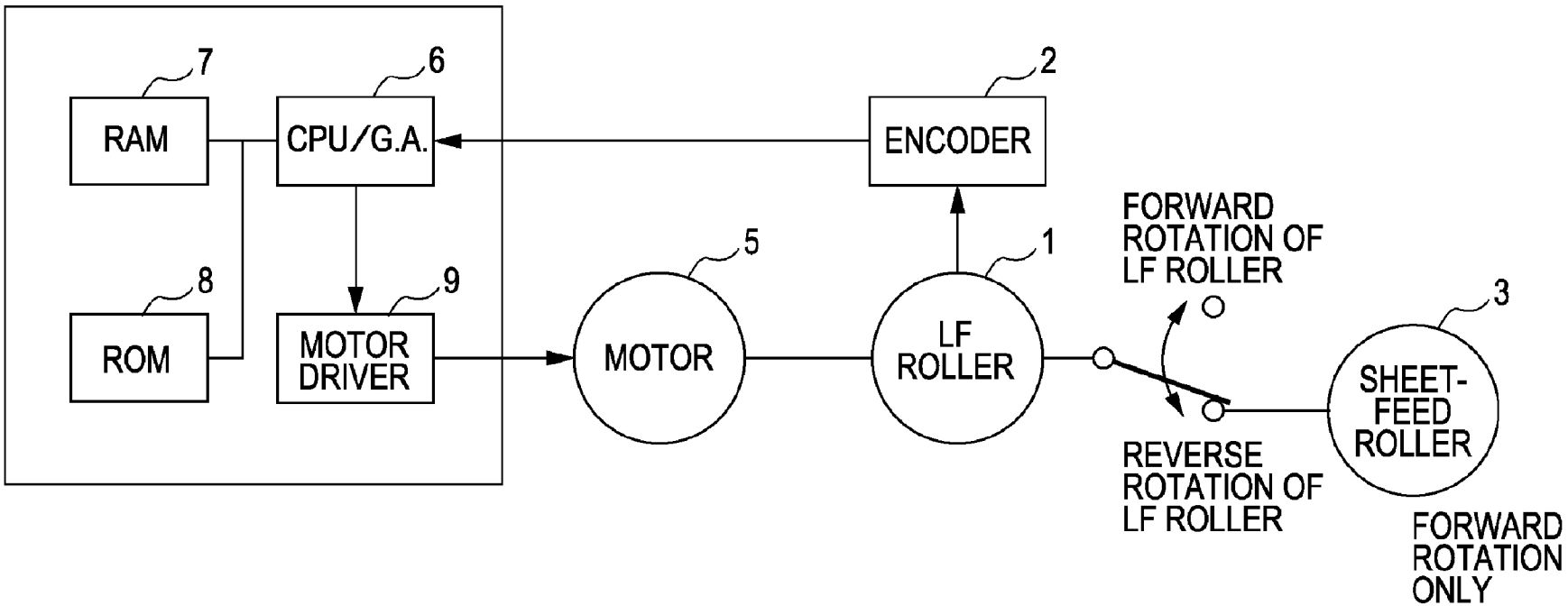
FIG. 2 is a block diagram illustrating controlling of the recording device (conveying device) according to an embodiment.

FIG. 2 is a block diagram illustrating controlling of the conveying device according to the embodiment. Reference numeral 5 denotes a motor, which is a driving source of the LF roller (conveying roller) 1 and the sheet-feed roller 3. The motor 5 is, for example, a DC motor. In the embodiment, driving force of the motor 5 is transmitted at all times to the LF roller 1. The driving force of the motor 5 is transmitted to the sheet-feed roller 3 through a switching unit that switches between transmission and non-transmission states. When the switching unit is in the transmission state, the driving force of the motor 5 rotates both the LF roller 1 and the sheet-feed roller 3.

By virtue of the structure of the transmission system of the conveying device, the direction of rotation of the sheet-feed roller 3 and the direction of rotation of the LF roller 1 are opposite to each other, and the direction of rotation of the motor 5 and the direction of rotation of the LF roller 1 are the same.

Figure 4:
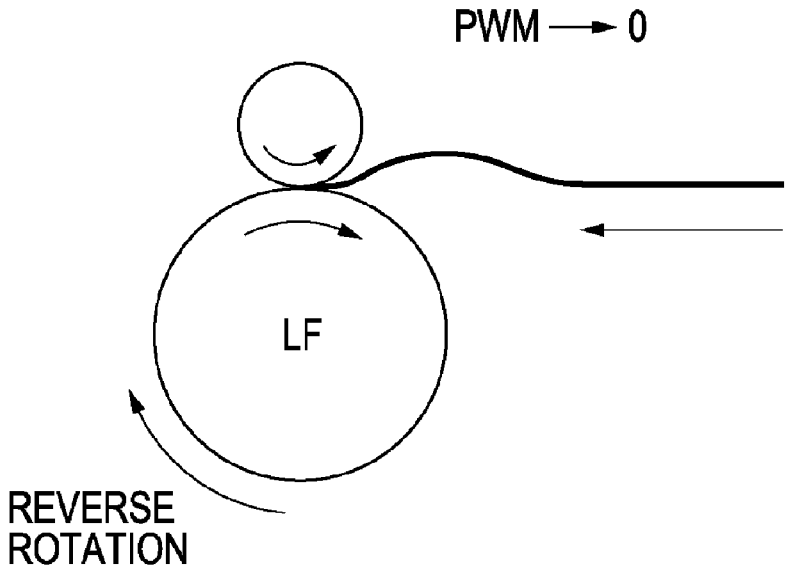
FIG. 4 illustrates a portion of the conveying device during a sheet feeding operation according to an embodiment.

When a sheet is picked up by the sheet-feed roller 3, to reverse the rotation of the motor 5, the LF roller 1 is set in a reverse-rotation state (that is, is rotated in a direction in which a sheet is not conveyed). As shown in FIG. 4, the LF roller 1 and a pinch roller contact each other to form a nip. An edge of a sheet conveyed by the sheet-feed roller 3 reaches the nip. After the edge of the sheet reaches the nip, it is conveyed for a predetermined amount of time. Therefore, the sheet is set in a state such as that shown in FIG. 4. By abutting the sheet in this way, even if the sheet is obliquely conveyed, the orientation of the sheet can be corrected. Thereafter, the direction of rotation of the motor is reversed to perform driving. This causes the LF roller 1 to convey the sheet downstream in the direction of conveyance of the sheet.

Such a controlling operation is performed by a CPU/G.A. (gate array) 6, which operates on the basis of a program that is stored in ROM 8. RAM 7 is a working memory of the CPU 6.

ROM 8 stores various parameters in addition to the program. For example, ROM 8 stores a speed driving pattern.

Reference numeral 9 denotes a motor driver for driving the motor 5. The motor 5 is driven as a result of servo control (feedback control) using information obtained from the encoder 2. The servo control is performed when the CPU 6 executes the program, which is stored in ROM 8, and is repeated every servo period ΔT.

A PWM signal that is output to the motor driver 9 from the CPU/G.A. (gate array) 6 is represented by duty value (that is, a ratio between high level and low level or a ratio between on and off). The range of this duty value is from 0% to 100%. The larger the duty value, the larger the electrical power supplied to the motor.

Figure 3:
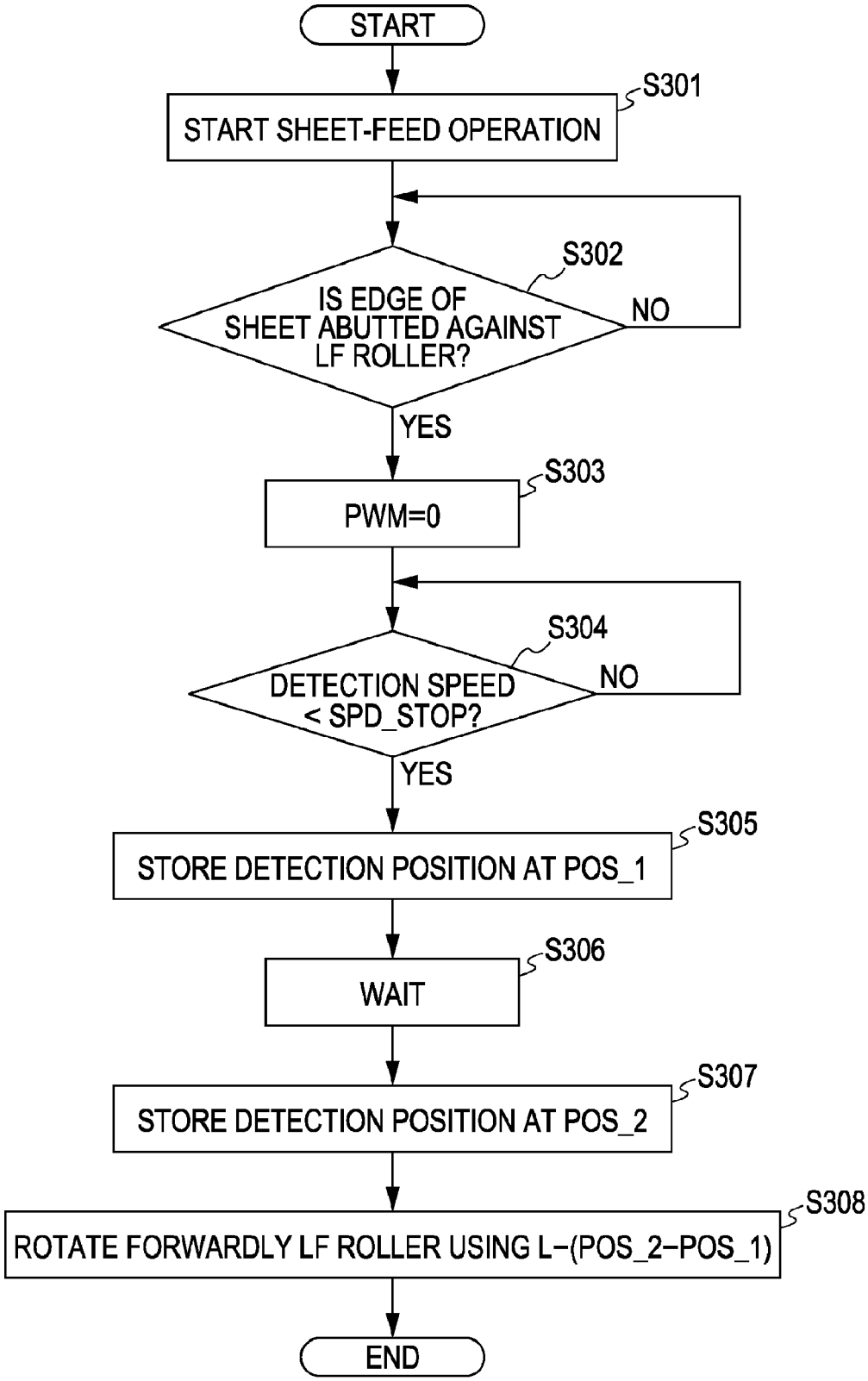
FIG. 3 is a flowchart of a sheet-feeding operation according to an embodiment.

FIG. 3 is a flowchart of controlling conveyance of a sheet according to an embodiment. First, in Step S301, a sheet-feeding operation is started. The sheet-feed roller 3 is rotated in the forward direction, and the LF roller is rotated in the reverse direction to convey a sheet at the tray 10 towards the LF roller 1.

Next, in Step S302, a determination is made as to whether or not an edge of the sheet is abutted against the LF roller 1. The determination is made on the basis of a change in the value of the PWM signal (voltage signal of a PWM waveform) that is output to the motor driver. However, the determination may be made by a sensor provided near the LF roller 1.

When, in Step S302, it is determined that an edge of the sheet is abutted against the LF roller 1, the process proceeds to Step S303. In contrast, if, in Step S302, it is determined that an edge of the sheet is not abutted against the LF roller 1, Step S302 is performed again after the servo period ΔT has elapsed.

Then, in Step S303, a stopping operation is performed. In this stopping operation, the PWM signal (PWM value) is set to 0%. However, the stopping method is not limited thereto.

Next, in Step S304, a determination is made as to whether or not a stopped state of the LF roller 1 is achieved on the basis of a threshold value and speed obtained by the encoder 2. For example, a determination is made as to whether or not detection speed <SPD_STOP. "SPD_STOP" is a threshold value, and is close to zero. That is, using this threshold value, a determination is made as to whether or not the detection speed is sufficiently reduced to a speed close to zero.

A state resulting from a determination that the speed is not sufficiently reduced in Step S304 corresponds to a state in which the LF roller 1 is rotating in the reverse direction. If, in Step S304, a determination is made that the speed is sufficiently reduced, the process proceeds to Step S305. In contrast, if, in Step S304, a determination is made that the speed is not sufficiently reduced, Step S304 is carried out again after the servo period ΔT has elapsed.

Figure 7:
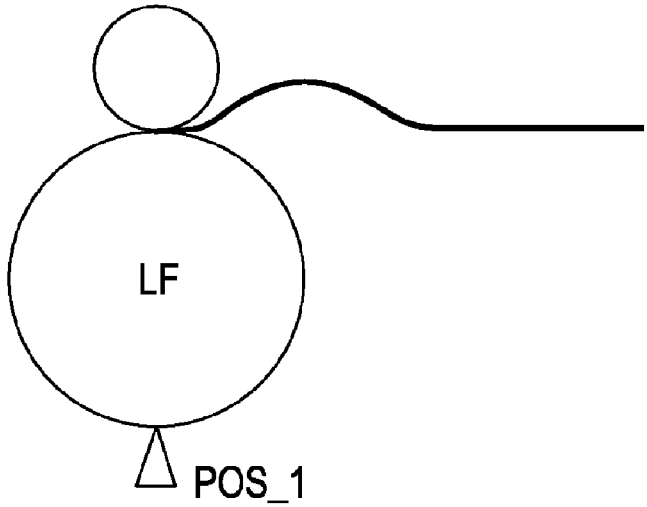
FIG. 7 illustrates an edge of a sheet abutting against the LF roller during a sheet-feeding operation according to an embodiment.

Next, in Step S305, position information obtained by the encoder 2 is stored at POS_1 of a memory. A value stored at the POS_1 corresponds to information of the position where the LF roller 1 is stopped. FIG. 7 shows a state of the LF roller 1 in Step S305. More specifically, FIG. 7 illustrates an edge of the sheet being conveyed by the conveying device abutting against the LF roller during a sheet-feeding operation. The timing of the sheet-feeding state illustrated in FIG. 7 corresponds to a period (timing) in which the LF roller 1 is changed from its reverse rotation state to its forward rotation state.

Next, in Step S306, the LF roller 1 waits for a predetermined time. While waiting, the LF roller 1 is rotated forwardly by backlash of a mechanical system. That is, the LF roller 1 rotates in a direction that is opposite to its previous direction of rotation.

Figure 8:
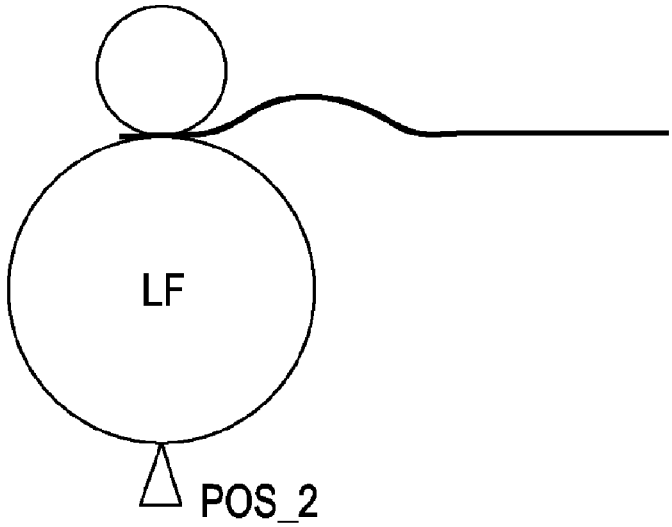
FIG. 8 illustrates the sheet displaced from the position shown in FIG. 7 as a result of the LF roller rotating forwardly caused by backlash of a mechanical portion of the conveying device during the sheet-feeding operation according to an embodiment.

After waiting, in Step S307, position information obtained by the encoder 2 is stored at POS_2 of the memory. FIG. 8 shows a state of the LF roller 1 in Step S307. More specifically, FIG. 8 illustrates the sheet being displaced from the position shown in FIG. 7 as a result of the LF roller rotating forwardly caused by backlash of a mechanical portion of the conveying device during the sheet-feeding operation.

Next, in Step S308, the LF roller 1 is rotated using L and the information at POS_2 and POS_1. ΔL corresponds to the difference between POS_2 and POS_1, and represents the amount of movement of the sheet caused by the LF roller 1 that has moved due to the backlash. A distance ΔL is, for example, 4 to 5 mm.

Figure 9:
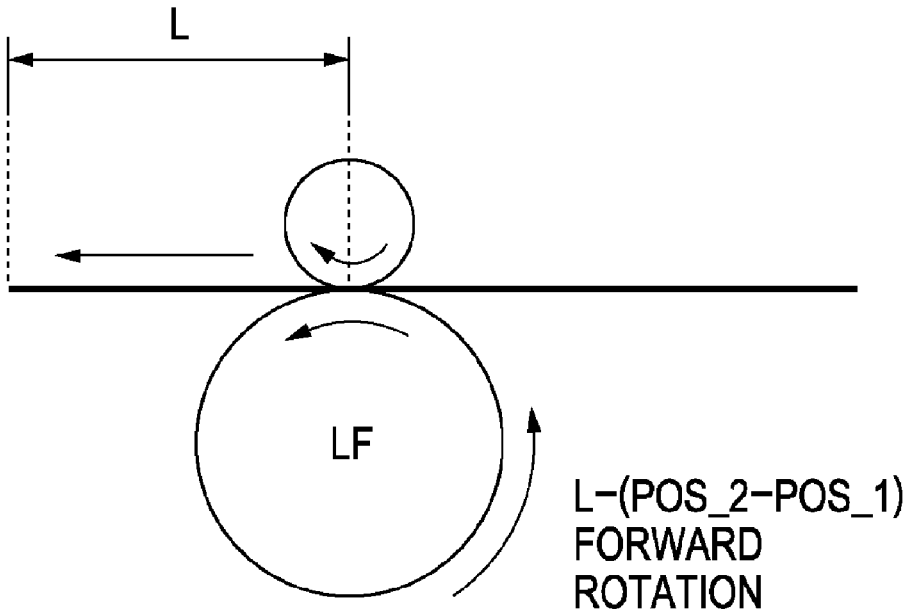
FIG. 9 illustrates the sheet conveyed via the LF roller to a print start position during the sheet-feeding operation according to an embodiment.

The state of the LF roller 1 in Step S308 is shown in FIG. 9. In particular, FIG. 9 illustrates the sheet is conveyed to a print start position from the position shown in FIG. 8. Here, L represents a conveyance distance from the position where an edge of the sheet abuts against the LF roller 1 to a target position to which the sheet is conveyed. For example, an amount corresponding to L−ΔL is calculated to perform driving. If a recording device is used, this target position is a recording position provided at the recording device. A recording head performs recording on a recording medium at this recording position.

The process illustrated in FIG. 3 is summarized as follows. The detection position POS_1 for the moment when the state of rotation of the LF roller 1 is switched from its reverse rotation state after the sheet abuts against the LF roller 1 to its forward rotation state resulting from backlash of the mechanical system is stored. Then, the detection position POS_2 for after the forward rotation of the LF roller 1 resulting from the backlash is stored. By correcting the difference between POS_2 and POS_1, it is possible to correctly convey the sheet to a predetermined conveyance position.

Figure 10:
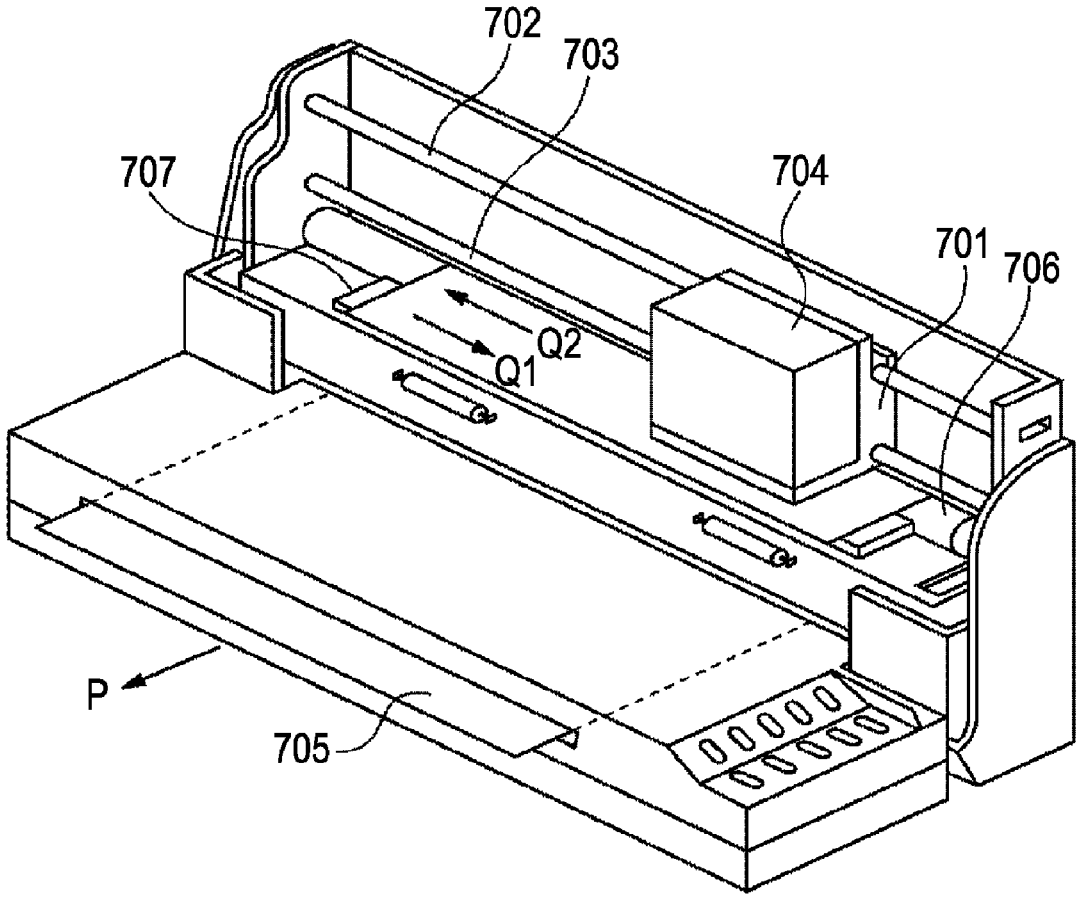
FIG. 10 is a perspective view of the recording device according to an embodiment.

In FIG. 10, a recording head 704, which is carried by a carriage 701, has a discharge port (nozzle) and an ink tank. The discharge port allows ink to be discharged. The ink tank contains the ink. The discharge port of the recording head 704 is provided above the carriage 701 so as to face downward. This allows the discharge port to discharge the ink onto a recording medium 705 that is positioned below the discharge port, so that recording is performed on the recording medium 705. When the recording head 704 scans the recording medium 705, it traverses the aforementioned recording position.

Two guide shafts 702 and 703 support the carriage 701 so that the carriage 701 can move in the directions of extension of these guide shafts 702 and 703. Driving a carriage motor (not shown) causes the carriage 701 to reciprocate and scan a scanning area including a recording area in the directions of arrows Q1 and Q2, which are main scanning directions. When one main scanning by the carriage 701 is completed, the LF roller 706 conveys the recording medium 705 by a constant amount (that is, a distance corresponding to a recording width of the recording head 704) in a sub-scanning direction, which corresponds to the direction of arrow P. Accordingly, the scanning of the recording head 704 and the conveyance of the recording medium 705 are repeated to record one page. Reference numeral 707 denotes a platen.

Figure 11A:
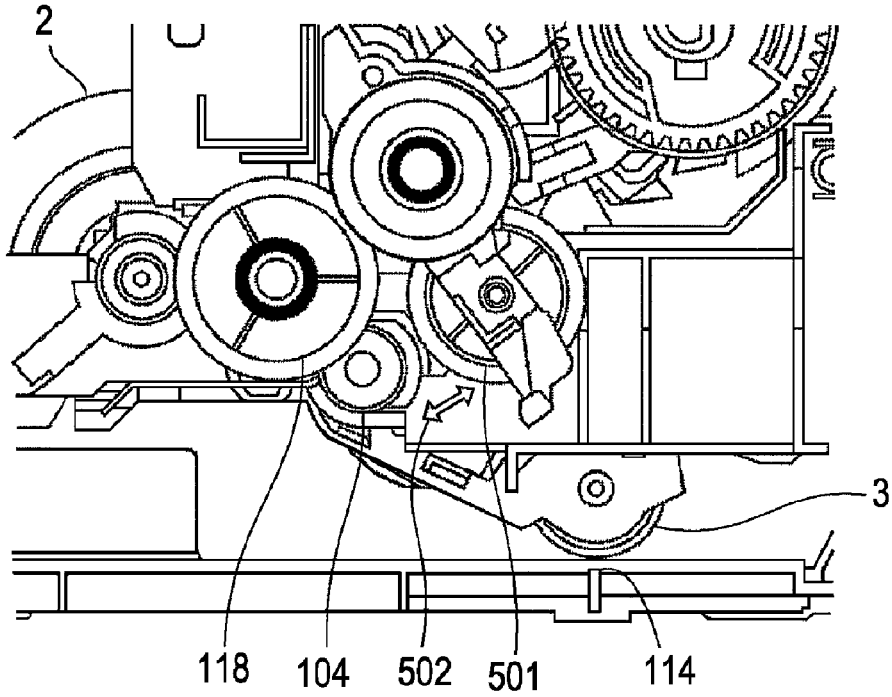
FIGS. 11A and 11B are partial views for explaining a sheet feed roller and a swing arm in an exemplary embodiment of the present invention.

FIG. 11A shows a state where a transmission gear 501 contacts the gear 104. This state represents a state where the sheet feed roller 3 can be rotated, and it corresponds to a state P2 in FIG. 11B. When the motor 5 is rotated in that state, the recording medium in the tray 114 can be picked up. A gear 118 transmits the driving force of the motor 5 to a gear mounted to the swing arm 101.

Figure 11B:
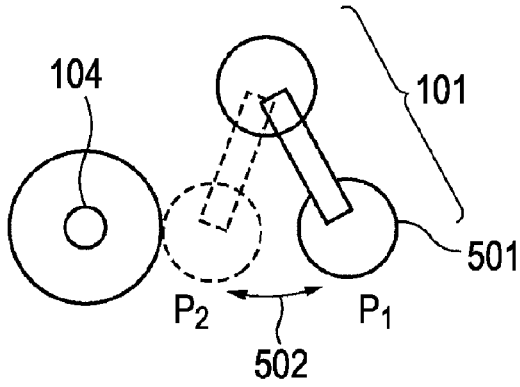

As shown in FIG. 11B, the swing arm 101 is moved between positions P1 and P2 in directions denoted by a double-headed arrow 502 in accordance with the driving of the motor 5.

When the motor 5 is rotated backward, the swing arm 101 is moved from the position P1 to the position P2. Also, when the motor 5 is rotated forward, the swing arm 101 is moved from the position P2 to the position P1.

Figure 5:
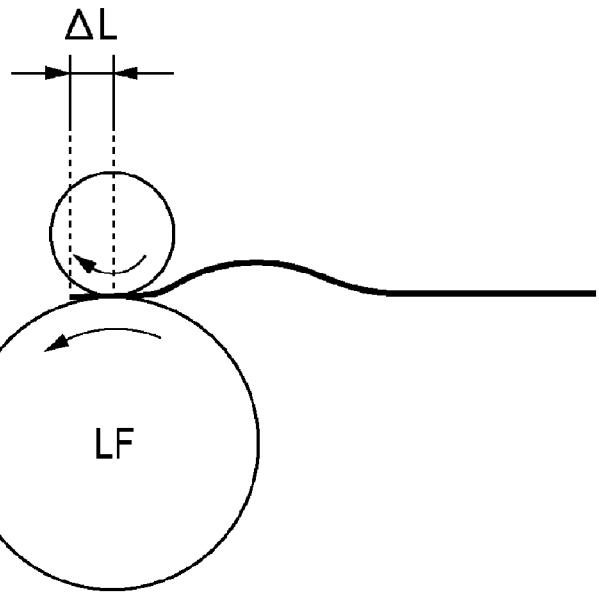
FIG. 5 illustrates a portion of a conveying device during a sheet-feeding operation when sheet-displacement-correction operations according to an embodiment are not carried out.

Lastly, a supplementary explanation of a case in which the operations according to an embodiment the present invention are not carried out will be given with reference to FIGS. 5 and 6. For example, a determination is made that a sheet abuts against an LF roller on the basis of a PWM value, and the PWM value is set to zero. As a result, after the LF roller stops, as shown in FIG. 5, the LF roller rotates forwardly to convey the sheet by a distance ΔL in a conveyance direction.

Figure 6:
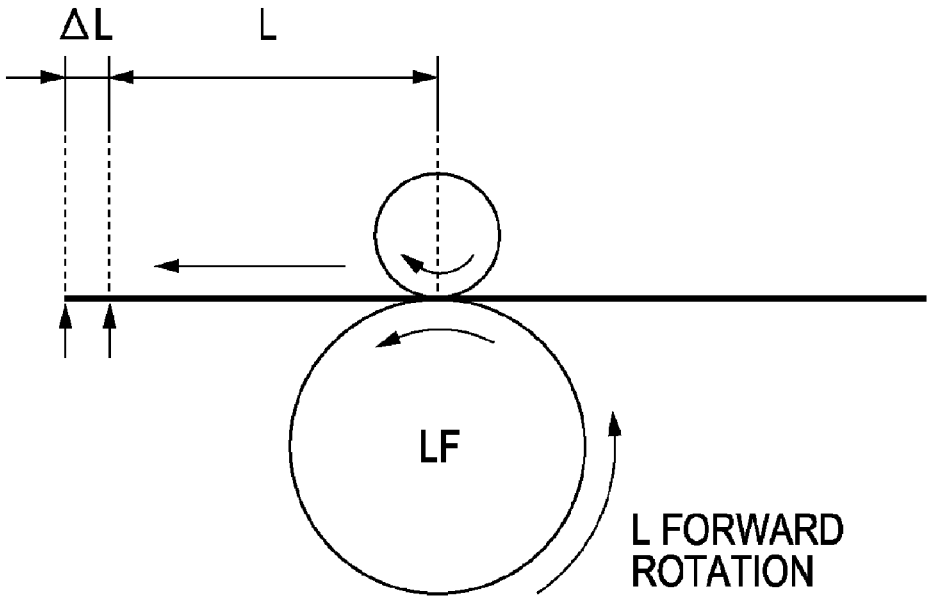
FIG. 6 illustrates a portion of the conveying device shown in FIG. 5 during the sheet-feeding operation when the sheet-displacement-correction operations according to an embodiment are not carried out.

Therefore, unless ΔL corresponding to the amount of backlash is considered, as shown in FIG. 6, the sheet is displaced from a conveyance target position by ΔL. Moreover, the value of ΔL is not a fixed value, but varies with sheet-feed operations. That is, the backlash amount varies with sheet-feed operations.

To supplement the foregoing description, in a structure that differs from that of the illustrated embodiment (such as a structure in which a conveying roller and a sheet-feed roller are driven by separate motors, respectively), even if the same driving control operation is performed on the conveying roller and the sheet-feed roller, a displacement that is as large as that above does not occur. That is, the value ΔL is much smaller, so that the sheet displacement can be ignored.

Therefore, by virtue of the structures of the above-described embodiments, it is possible to eliminate the influence of torque that varies with each sheet-feed operation, such as backlash, so that positional displacement of a sheet that is being conveyed can be restricted.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-188045 filed Jul. 7, 2006, which is hereby incorporated by reference herein in its entirety.

What is claimed is:

1. A conveying device comprising:

a sheet-feed roller that picks up a sheet stacked at a sheet-stacking portion;

a conveying roller that conveys the sheet conveyed by the sheet-feed roller;

a DC motor serving as a driving source of the sheet-feed roller and the conveying roller;

a motor control unit configured to generate a control signal for driving the DC motor using information obtained from at least one encoder;

a driving unit configured to drive the DC motor as a result of inputting the control signal generated by the motor control unit;

a determining unit configured to determine a timing in which the sheet conveyed by the sheet-feed roller reaches the conveying roller, based on a threshold value and a voltage of the control signal; and a control unit configured to, after rotation of the sheet-feed roller is started, stop the rotation of the sheet-feed roller based on the timing determined by the determining unit, and to start rotation of the conveying roller after a waiting time after the rotation of the sheet-feed roller is stopped, wherein the control unit controls an amount of conveyance of the conveying roller after the waiting time based on information about an amount of change in position during the waiting time obtained from the at least one encoder.

2. The conveying device according to claim 1, further comprising an obtaining unit configured to obtain information regarding the rotation position provided at the timing and that provided after waiting.

3. The conveying device according to claim 1, wherein the at least one encoder is provided at the conveying roller, and outputs the information in accordance with the rotation of the conveying roller.

4. The conveying device according to claim 1, wherein the DC motor drives the sheet-feed roller and the conveying roller independently of each other, the at least one encoder includes a plurality of encoders, and the sheet-feed roller and the conveying roller are provided with the respective encoders.

5. The conveying device according to claim 1, wherein the conveying device comprises a transmission unit having a transmission state in which a driving force transmitted from the DC motor for driving the conveying roller is transmitted to the sheet feed roller and a non-transmission state in which the driving force is not transmitted to the sheet feed roller, the transmission unit being configured to switch over the transmission state and the non-transmission state depending on a rotating direction of the DC motor.

6. A method of controlling a conveying device comprising a sheet-feed roller that picks up a sheet stacked at a sheet-stacking portion, a conveying roller that conveys the sheet conveyed by the sheet-feed roller, a DC motor serving as a driving source of the sheet-feed roller and the conveying roller, a motor control unit configured to control driving of the DC motor using information obtained from an encoder, and a driving unit configured to drive the DC motor as a result of inputting a control signal generated by the motor control unit, the method comprising:

driving the sheet-feed roller;

determining an arrival timing in which the sheet that is being conveyed by the sheet-feed roller reaches the conveying roller, based on a threshold value and a voltage of the control signal and during driving of the sheet-feed roller;

outputting the control signal for stopping rotation of the DC motor, based on the determined arrival timing;

outputting the control signal for starting rotation of the DC motor after a waiting time after stopping of the DC motor;

determining an amount of rotation of the conveying roller after the waiting time based on position information obtained from the encoder during the waiting time; and driving the conveying roller based on the determined amount of rotation.

7. A recording device that performs recording on a recording position using a recording head, the recording device comprising:

a sheet-feed roller that picks up a sheet stacked at a sheet-stacking portion;

a conveying roller that conveys the sheet conveyed by the sheet-feed roller to the recording position;

a DC motor serving as a driving source of the sheet-feed roller and the conveying roller;

a motor control unit configured to generate a control signal for driving the DC motor using information obtained from an encoder;

a driving unit configured to drive the DC motor as a result of inputting a control signal generated by the motor control unit;

a determining unit configured to determine a first timing and a second timing, the first timing being determined based on a threshold value and a voltage of the control signal and being a timing in which the sheet conveyed by the sheet-feed roller reaches the conveying roller, the second timing being a timing in which the conveying roller is stopped after the first timing; and a control unit configured to stop rotation of the sheet-feed roller based on the first timing after the rotation of the sheet-feed roller is started, and to start rotation of the conveying roller after a waiting time for a predetermined time after the rotation of the sheet-feed roller is stopped, wherein the control unit controls an amount of conveyance of the conveying roller after the waiting time based on position information provided after the waiting time and position information based on the second timing, the items of position information being obtained from the encoder.

8. A conveying device comprising:

a sheet-feed roller that picks up a sheet stacked at a sheet-stacking portion;

a conveying roller that rotates in a conveying direction to convey the sheet conveyed by the sheet-feed roller;

a DC motor serving as a driving source of the sheet-feed roller and the conveying roller;

a transmitting unit configured to transmit a drive force to the sheet-feeding roller when the conveying roller is rotated in a direction opposite to the conveying direction by the DC motor;

a control unit configured to, after an edge of the sheet is abutted against the conveying roller, stop the DC motor, and to start the DC motor for rotating the conveying roller in the conveying direction after a waiting time after the rotation of the sheet-feed roller is stopped; and an encoder outputting a signal in accordance with the rotation of the conveying roller, wherein the control unit controls an amount of conveyance of the conveying roller after the waiting time based on an information about an amount of rotation of the conveying roller during the waiting time obtained from the encoder.

* * * * *